United States Patent [19]

Koike

[11] 4,234,024

[45] Nov. 18, 1980

[54] VENEER LATHE

[75] Inventor: Masaru Koike, Ohbu, Japan

[73] Assignee: Meinan Machinery Works, Inc., Aichi, Japan

[21] Appl. No.: 31,326

[22] Filed: Apr. 18, 1979

[30] Foreign Application Priority Data

Apr. 20, 1978 [JP] Japan ..... 53-47457

[51] Int. Cl.[3] ..... B27L 5/02

[52] U.S. Cl. ..... 144/213

[58] Field of Search ..... 144/209 R, 213, 212, 144/214, 215

[56] References Cited

U.S. PATENT DOCUMENTS

| | | | |
|---|---|---|---|
| 3,680,613 | 8/1972 | Daniels et al. | 144/209 R |
| 4,061,169 | 12/1977 | Hasegawa | 144/209 R X |

FOREIGN PATENT DOCUMENTS

| | | | |
|---|---|---|---|
| 2755097 | 7/1978 | Fed. Rep. of Germany | 144/213 |
| 2905786 | 8/1979 | Fed. Rep. of Germany | 144/213 |

*Primary Examiner*—Willie G. Abercrombie

*Attorney, Agent, or Firm*—Lackenbach, Lilling & Siegel

[57] ABSTRACT

A new type of veneer lathe which comprises threaded cylinders as a means for exerting a driving force onto the periphery of a log. The tread on each cylinder is edged such that when pressed it cuts into the log periphery, and the cylinder is axially rotated to exert a rotary driving force onto the log periphery. Since the bottom end portion contacts the log immediately ahead of the edge of a cutting knife, the force which is exerted on the log to overcome the cutting resistance will not break soft wood of a poor quality log.

19 Claims, 14 Drawing Figures

VENEER LATHE

BACKGROUND OF THE INVENTION

The present invention relates to a veneer lathe for cutting off a veneer from a turned log, and more particularly to a veneer lathe provided with log driving means in the form of threaded cylinders.

In a series of inventions directed to rotating a log by exerting a force onto its periphery, a common element is a drive roller provided with a plurality of edged members on its periphery and disposed slightly ahead of the knife edge. (See, for example, U.S. Patent application Ser. No. 861,278; filed Dec. 16, 1977, entitled "Vereer Lathe" and invented by Katsuji Hasegawa assignor to the assignee of the present patent application).

The principle object of such series of inventions aims at exerting a force onto the log periphery to reduce the load on the log core portion since inferior quality logs must be used for producing veneer nowadays. In order to achieve said object, it is essential to exert a driving force onto the log periphery slightly ahead of the knife edge. Indeed, the drive roller type veneer lathe is thus constructed. However, it is still unsatisfactory for minimizing the core load, because edged members mounted on the drive roll come into piercing engagement with the log periphery somewhat ahead of the knife edge. Also, if the roller position is changed for minimizing the distance between the knife edge and the engagement point, it is inevitable that edged members interfere with the blade of the knife due to the endless structure of the drive roll surface, resulting in the breakage of the edged members. It is also proposed to reduce the roller size but in this way the number of penetrating edged members decreases with the result that the log is not given a sufficient driving force.

SUMMARY OF THE INVENTION

In order to overcome the disadvantages and drawbacks of the roller type veneer lathe, the present invention provides a novel type of veneer lathe which is provided with a plurality of threaded cylinders vertically juxtaposed as a means of driving the log. The feature of the arrangement is that said cylinders have at least one edged thread upon its periphery and that the bottom end of the cylinders are located immediately ahead of the knife edge.

DETAILED DESCRIPTION OF EMBODIMENTS

Figure 1:
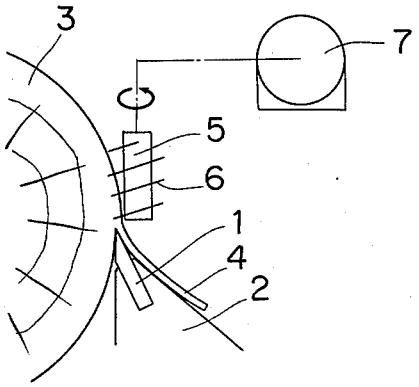
FIG. 1 is a diagrammatic sectional view of one embodiment of the present invention.
Figure 2:
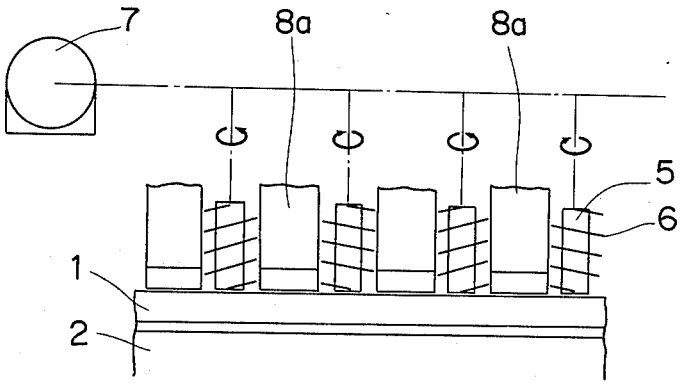
FIG. 2 is a diagrammatic plan view of the embodiment shown in FIG. 1.
Figure 3:
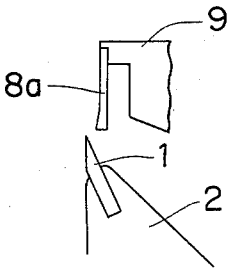
FIGS. 3 to 5 are diagrammatic sectional views of various modifications of pressure means used in the above embodiment.
Figure 4:
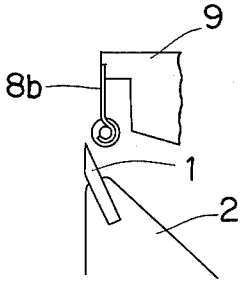
Figure 5:
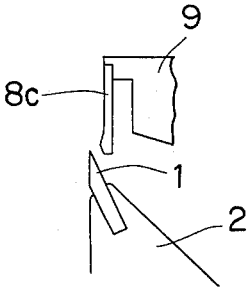

Referring to FIGS. 1 and 2, a knife 1 is mounted on a knife support 2 which is in turn firmly mounted on a suitable post. Log 3 is rotatably supported by suitable means (not shown) rotatably about its axis. Knife 1 is provided near the log 3 and is adapted to be moved sideways to and from the log until the knife edge contacts the log 3 at its surface in a tangential mode to cut off a veneer 4. Above knife 1, a plurality of threaded cylinders 5 are vertically juxtaposed in facing relation to the log above the knife edge and along its entire width. Each cylinder 5 has an edged thread 6 thereon integrally around its periphery. However, cylinders having left-hand threads are adapted for clockwise axial rotation while those having right-hand threads for counterclockwise axial rotation. Left-hand cylinders and right-hand cylinders are arranged alternately. Threads 6 are regularly pitched on any cylinder. With this arrangement, the bottom ends of the cylinders are located immediately ahead of the knife edge. Said cylinders 6 are adapted for lateral movement to and from the log together with the knife. Motor 7 axially rotates the cylinders 5. Between each two adjacent cylinders, there is provided a pressure bar **8*a* as shown in FIG. 3 to press the log periphery slightly ahead of the knife edge. Said pressure bar 8*a* is mounted on a pressure bar support 9. Said pressure bar 8*a* may be replaced with a roller bar 8*b* or a double-face bar as shown in FIG. 4. In each case, it is preferable to use a leaf spring as the pressure means. Knife support 2, cylinders 5, and pressure bars 8*a*** are connected to form a unitary structure which is moved to and from the log.

Hereinafter, the operation of this embodiment will be explained. The unitary structure including knife 1, knife support 2, cylinders 5 and pressure bars **8*a* is fed toward the log until edged threads 6 cut into the log surface and the knife edge contacts the log in a substantially tangential mode. Since said edged threads are axially rotated, the rotatably supported log 3 is driven to rotate clockwise. As a result, the knife 1 cuts a veneer 4 from log 3. To be particularly noted in this operation is that the lower end portions of cylinders 5 drive log 3** immediately ahead of the knife edge.

Figure 6:
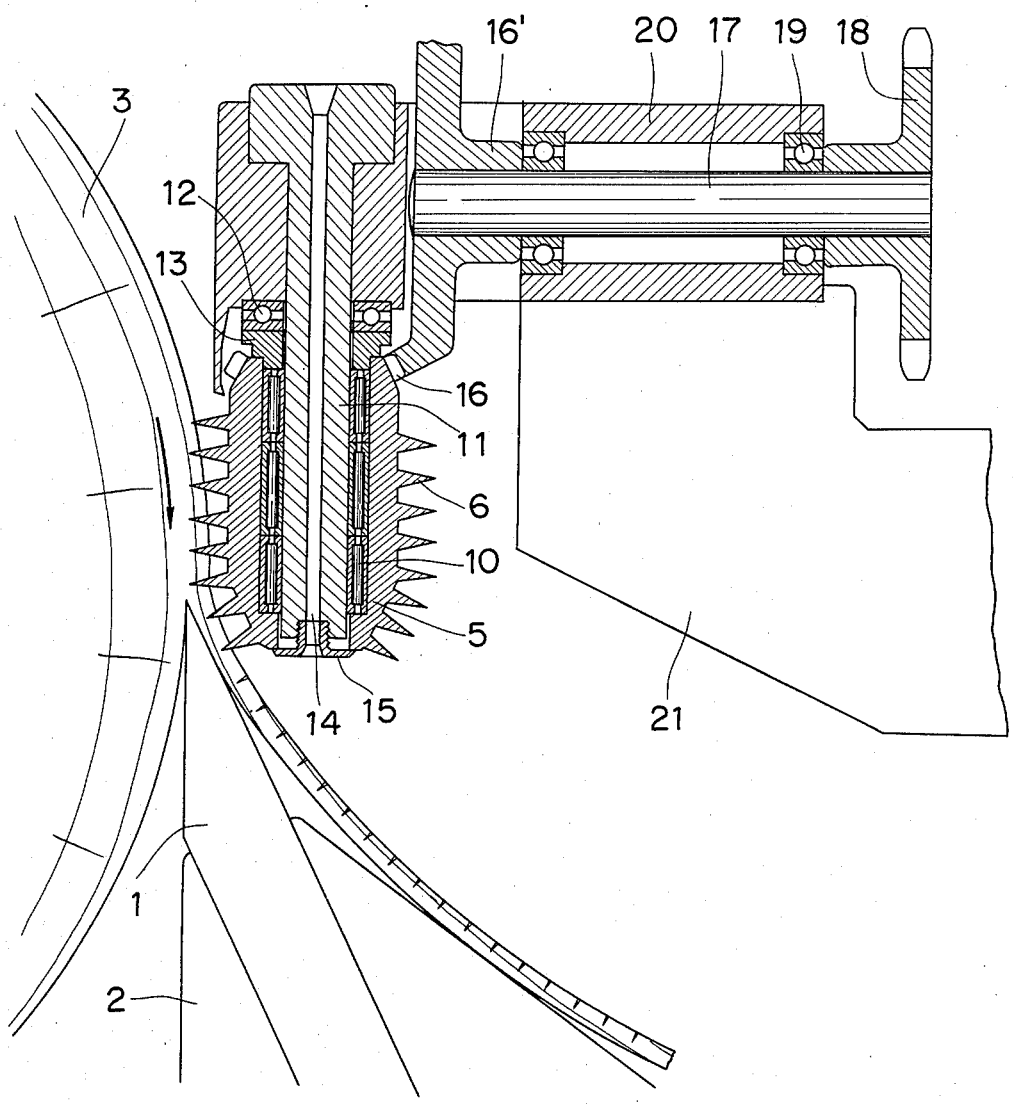
FIG. 6 is a sectional side view of another embodiment of the present invention.

Another embodiment of the present invention is shown in FIG. 6. Its general structure is substantially the same as that of the embodiment of FIGS. 1–5. However, each cylinder 50 has a converging extension having an arched profile at its bottom end portion. Said extension is provided with an auxiliary thread forming a continuation of the edged thread which passes the knife edge to extend in substantially parallel relation to the blade of knife 1 such that the edge of the thread will not touch the blade. Cylinder 5 is radially received by a needle bearing 10 which is, in turn, supported by a pin 11 whereas it is axially received by a thrust bearing 12 by way of a collar 13. Pin 11 has a hole 14 and is fastened by a set screw 15. Cylinder 5 is coupled by way of bevel gears 16 and 16' to shaft 17 which, in turn, is provided with a sprocket 18 at its opposite end. Said shaft 17 is received by bearing 19, which, in turn, is supported by a metal member 20. Said metal member is supported by a support beam 21. A plurality of such assemblies are juxtaposed in facing relation to the log 3 and are coupled to the knife support 2 to form a unitary structure. Around each sprocket 18, a clain (not shown) is trained and driven by a suitable power source (not shown).

The operation of this embodiment is practically the same as that of the foregoing embodiment. However, the cutting can be more effectively done since the driving force is provided both on the log periphery immediately ahead of the knife edge and on the cut veneer which is past the knife edge.

Figure 7:
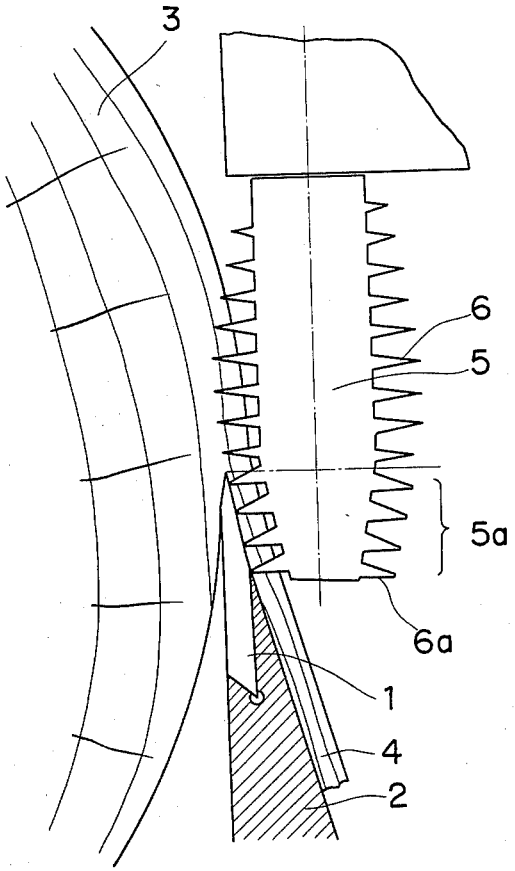
FIG. 7 is a diagrammatic sectional side view of a further embodiment of the present invention.
Figure 8:
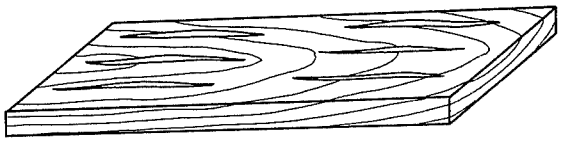
FIG. 8 shows a sheet of veneer cut off from the log, which sheet has cuts formed by an edged thread on the cylinder of the veneer lathe according to the present invention.

FIG. 7 shows a further embodiment of the present invention. The general structure of this embodiment is substantially the same as that of the foregoing embodiments. However, the cylinder 5 has a conical extension 5*a* which converges downward past the knife edge. Said conical extension has a thread 6*a* thereon. Said thread 6*a* has a blunted edge which is guided into a groove formed by the edged thread 6 and contacts the blade of the knife 1 such that knife 1 is firmly held by the cylinder 5. This enables use of thin and sharp-angled knives with the result that veneer cut off from the log has an improved surface quality.

With all of the afore-mentioned embodiments, various minor modifications are possible. For example, only one thread is formed on each cylinder but it is acceptable if a plurality of threads are formed on each cylinder. The thread is regularly pitched in the above embodiments. However, such thread can be replaced by an irregularly-pitched thread. Also, the thread is integrally provided on the cylinder in the foregoing embodiments. It is, however, advisable to provide a replaceable thread member around the cylinder. The above modifications brings about various effects in cutting off a veneer from the log. For example, provision of plural threads enables the amount of log rotational angle by one pitch to increase. Irregularly-pitched threads have such an effect as to exert tension or compression on the log surface to give a tenderizing effect to a veneer cut off from the log, which is extensively known. Replacement of threads is also instrumental in permitting use of various kinds of threads according to the quality of the log. Normally, the cylinders are juxtaposed at a regular intervals along the whole length of the knife 1. In actual use, they are progressively closer pitched toward the log ends and relatively wide pitched at its median portion. This lessens the possible bending of the log 3. FIG. 2 shows an alternate arrangement of left-hand cylinders and right-hand cylinders. However, it is also acceptable if all the cylinders in a veneer lathe are either left-hand cylinders or right-hand cylinders.

Although the force required to rotate log 3 is exerted by cylinders 5 alone in the foregoing embodiments, log 3 may be rotated by a spindle chuck holding the log core where the log shape is so irregular that cylinders 5 will not engage the log surface properly. In this instance, however, special care must be taken to minimize a load on the log core.

Figure 9:
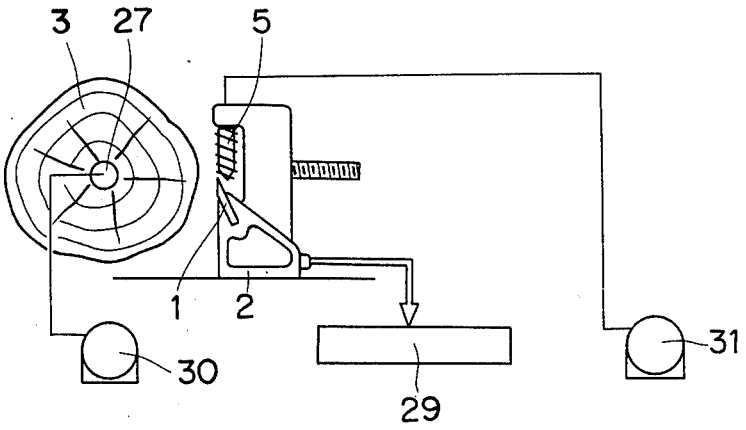
FIG. 9 to FIG. 14 are schematic illustrations of drive mechanisms used in the foregoing embodiments of the present invention.

Referring to FIG. 9, spindle 27 is provided with a drive mechanism 30. As in the foregoing embodiment, knife 1, knife support 2, cylinders 5 are moved to and from log 3. Sensor 29 detects the position of knife support and eventually the log diameter. Drive mechanism 31 drives cylinders 5.

Figure 10:
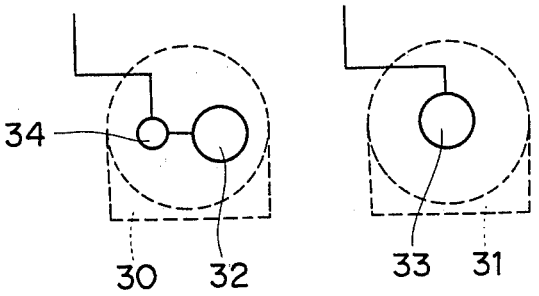

Referring to FIG. 10, the drive mechanism 30 includes a motor 32 and a torque limiting mechanism 34, for example, an electromagnetic clutch or a torque limiter. Drive mechanism 31 is equipped with a motor 33. In this embodiment, only a limited torque is supplied to the log 3 so that the core is not ruined. Log 3 turned in this way is subjected to the cutting operation but the principal force is provided by drive mechanism 31 through cylinders 5.

Figure 11:
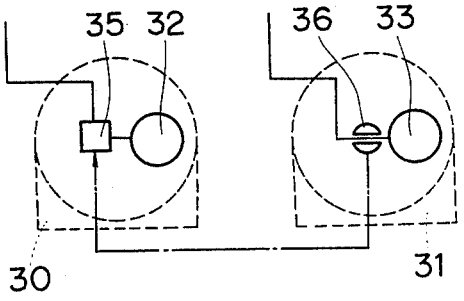

Referring to FIG. 11, drive mechanism 30 only rotates the log before the cutting operation. In other words, the force is supplied only by the drive mechanism 31 during the cutting operation. Drive mechanism 31 is equipped with current sensor 36 which detects a current to start motor 33 at the outset of a cutting operation and transmits a signal to a switch-off mechanism 35 for stopping the motor 32 of drive mechanism 30. Switch-off mechanism 35 may be of a clutch-type. Current sensor 36 may be replaced by a strain gauge or a switch which operates upon its contact on the log surface.

Figure 12:
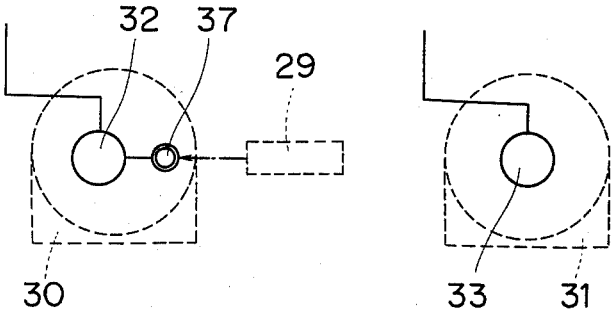

FIG. 12 shows a control mechanism 37 which controls the number of revolutions per unit time of motor 32 in response to a signal from log diameter sensor 29 until the peripheral speed of the log 3 becomes equal to the feed speed of cylinders 5. Such synchronization mechanism may be electrical or mechanical. The control mechanism may be equipped in both or either one of the drive mechanisms 30 and 31.

Figure 13:
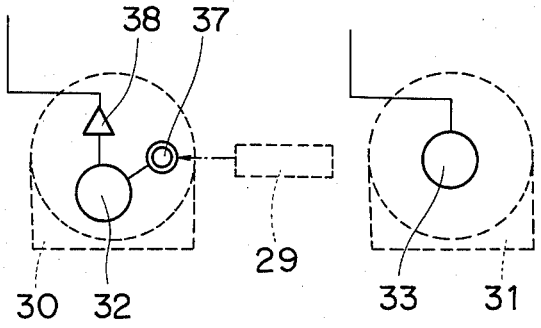

FIG. 13 shows a modification of the FIG. 12 embodiment. Drive mechanism 30 is further equipped with an overrunning clutch 38 to offset the extra speed of log rotation so that it is maintained smaller than the feed speed of cylinders 5.

Figure 14:
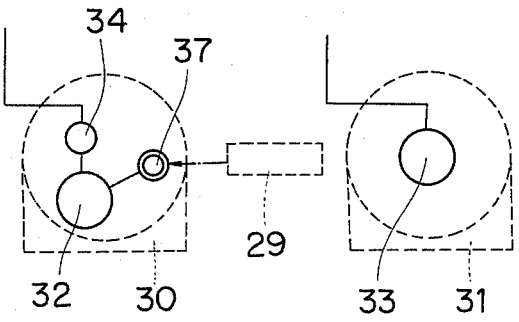

FIG. 14 shows a combination of the embodiments shown in FIG. 10 and FIG. 12.

Due to the essential feature of the invention in which the bottom end portions of the cylinders exert a driving force onto the log immediately ahead of the knife edge, the load on the log core during the veneer cutting operation is minimized. As a result, inferior quality logs which contain soft, rotten portions can be supplied as material for cutting off veneer. This greatly contributes to the improvement of productivity in plywood production.

Although the present invention has been described in some detail by way of illustration and example for purposes of clarity of understanding, it will, of course, be understood that various changes and modifications may be made in the form, details and arrangements of the parts without departing from the scope of the invention as set forth in the following claims.

What is claimed is:

1. A veneer lathe for cutting off veneer from a log which comprises (1) means for rotatably supporting said log about its axis;

(2) a knife provided near said log movably sideways away from and toward the log until the knife edge contacts the log surface in a tangential mode;

(3) a plurality of cylinders vertically juxtaposed in facing relation to the log periphery and each being provided with at least one edged thread thereon, the bottom end of each cylinder being located immediately ahead of the knife edge, said cylinders being adapted for axial rotation and lateral movement to and from the log; and (4) pressure means provided between each two adjacent cylinders for pressing the log periphery slightly ahead of the knife edge and adapted for lateral movement to and from the log.

2. A veneer lathe according to claim 1, wherein each cylinder is provided with a thread thereon.

3. A veneer lathe according to claim 1, wherein said thread is regularly pitched.

4. A veneer lathe according to claim 1, wherein said thread is irregularly pitched.

5. A veneer lathe according to claim 1, wherein said plurality of cylinders are provided with either a right-hand thread or a left-hand thread, and said cylinders having a right-hand thread and said cylinders having a left-hand thread being arranged alternately.

6. A veneer lathe according to claim 1, wherein said cylinders are progressively closer pitched towards the opposite ends of the log.

7. A veneer lathe according to claim 1, wherein each cylinder has a converging extension at its bottom end, and said extension being provided with an auxiliary thread forming a continuation of the edged thread.

8. A veneer lathe according to claim 7, wherein said auxiliary thread is blunted.

9. A veneer lathe according to claim 1, wherein said pressure means is resiliently urged toward the log.

10. A veneer lathe according to claim 9, wherein said pressure means include one of a nose bar, a roller bar, and a double-face bar.

11. A veneer lathe according to claim 1, wherein the cylinders are adapted to be driven by a main drive mechanism.

12. A veneer lathe according to claim 11, wherein the log is adapted to be driven by an auxiliary drive mechanism.

13. A veneer lathe according to claim 12, wherein said auxiliary drive mechanism is equipped with a torque limiting mechanism.

14. A veneer lathe according to claim 12, wherein the main drive mechanism is equipped with current sensor means for sensing a start of the main drive mechanism and transmitting a signal to the auxiliary drive mechanism, said auxiliary drive mechanism being equipped with a switch mechanism to switch off the second drive mechanism in response to said signal.

15. A veneer lathe according to claim 12, wherein said auxiliary drive mechanism is equipped with control means for controlling a log peripheral speed for sychronization with a feed speed by means of the cylinders.

16. A veneer lathe according to claim 15, wherein said auxiliary drive mechanism is further equipped with an overrunning mechanism to offset the extra speed of log rotation.

17. A veneer lathe according to claim 1, wherein said cylinders and said knife are mounted on a common support and move laterally together to and from said log.

18. A veneer lathe according to claim 1, wherein said pressure means and said cylinders are together adapted for lateral movement to and from the log.

19. A veneer lathe according to claim 1, wherein said pressure means, said knife and said cylinders are all mounted on a unitary structure adapted for lateral movement to and from said log.

* * * * *